US008347894B1

(12) United States Patent
Stewart et al.

(10) Patent No.: US 8,347,894 B1
(45) Date of Patent: Jan. 8, 2013

(54) MULTIPLE DISPENSING COMBS IN A SINGLE COMB BODY

(76) Inventors: Renee Gail Stewart, Stafford, VA (US); Robin Hardie Stewart, Woodbridge, VA (US)

( * ) Notice: Subject to any disclaimer, the term of this patent is extended or adjusted under 35 U.S.C. 154(b) by 0 days.

(21) Appl. No.: 12/926,165

(22) Filed: Oct. 29, 2010

(51) Int. Cl.
*A45D 24/22* (2006.01)

(52) U.S. Cl. ..... 132/114

(58) Field of Classification Search ..... 132/112–116; 401/17, 34–35, 47; 222/135, 192; D28/20–22, D28/30–31, 7; 604/226
See application file for complete search history.

(56) References Cited

U.S. PATENT DOCUMENTS

| | | | | | |
|---|---|---|---|---|---|
| 502,596 | A | * | 8/1893 | Suddoth | 222/135 |
| 727,312 | A | * | 5/1903 | Douglas | 132/112 |
| 924,048 | A | * | 6/1909 | Ensor | 132/116 |
| 1,007,042 | A | * | 10/1911 | Mosby | 401/47 |
| 1,686,936 | A | * | 10/1928 | Simpson | 132/114 |
| 2,128,183 | A | * | 8/1938 | Hickey | 132/111 |
| 2,139,904 | A | * | 12/1938 | Merrill | 132/114 |
| 2,166,295 | A | | 7/1939 | Hewitt | |
| 2,180,308 | A | * | 11/1939 | Marton | 132/114 |
| 2,218,471 | A | | 10/1940 | Hickey | |
| 2,225,282 | A | * | 12/1940 | Taborski | 132/114 |
| 2,250,878 | A | * | 7/1941 | Philip Quaranti | 401/28 |
| 2,376,065 | A | | 5/1945 | Kuszyk | |
| 2,446,398 | A | | 8/1948 | Wilson | |
| 2,456,687 | A | * | 12/1948 | Dominguez | 401/6 |
| 2,461,789 | A | * | 2/1949 | Usai | 132/111 |
| 2,591,125 | A | * | 4/1952 | Braun | 132/116 |
| 2,737,190 | A | * | 3/1956 | Magnusson et al. | 132/114 |
| 2,755,807 | A | * | 7/1956 | Jorgensen | 132/116 |
| 4,747,420 | A | * | 5/1988 | Alaimo | 132/112 |
| 5,056,480 | A | * | 10/1991 | Murray, Sr. | 132/114 |
| 5,339,839 | A | | 8/1994 | Forcelledo et al. | |
| 5,755,241 | A | * | 5/1998 | Cheung | 132/112 |
| 5,879,338 | A | * | 3/1999 | Mahurkar | 604/195 |
| 5,937,865 | A | * | 8/1999 | Dhaliwal | 132/114 |
| 6,491,464 | B1 | * | 12/2002 | Young | 401/35 |
| 6,877,924 | B1 | * | 4/2005 | Mears et al. | 401/190 |
| 6,962,158 | B1 | | 11/2005 | Anguelo | |
| 7,077,146 | B1 | * | 7/2006 | Eckerson | 132/113 |
| 7,311,456 | B1 | * | 12/2007 | Neal | 401/47 |
| 7,409,957 | B2 | | 8/2008 | Abergel | |
| 7,797,782 | B2 | * | 9/2010 | Davis et al. | 15/143.1 |
| 2005/0184091 | A1 | * | 8/2005 | Abergel | 222/145.5 |

FOREIGN PATENT DOCUMENTS

GB 2066059 A * 12/1979

* cited by examiner

*Primary Examiner* — Rachel Steitz
*Assistant Examiner* — Jennifer Gill
(74) *Attorney, Agent, or Firm* — Lawrence R. Franklin

(57) ABSTRACT

A fusion comb is a single comb which houses two separate and independent combs. Each independent comb has a manually operated plunger which forces a hair product through the comb and out of a set of outlets in the teeth of that comb. By withdrawing the plunger, liquid is suctioned through the teeth and into the comb.

15 Claims, 9 Drawing Sheets

FIGS. 3(I)-(VI)

MULTIPLE DISPENSING COMBS IN A SINGLE COMB BODY

CROSS-REFERENCES TO RELATED APPLICATIONS

Not Applicable.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

REFERENCE TO A "SEQUENCE LISTING"

Not Applicable.

BACKGROUND OF THE INVENTION (1) Field of the Invention

The disclosed invention pertains to a fusion or dual comb which contains internal compartments through which a fluent hair product is manually caused to flow and to exit the comb through outlets in the comb teeth into the hair and the scalp of the user. Throughout the specification, the inventive comb is alternatively referred to as a "fusion comb," a "dual comb." and a "single comb," The terms "fusion comb," "dual comb," and "single comb" are used interchangeably to refer to a single comb which internally houses two separate combs. "Fusion comb" is a name coined by the inventors for the single comb in its entirety. "Dual comb" refers to the entire single comb, but "dual comb" is a more visual, physical description of the entire single comb. The "dual comb" draws attention to the fact that there are two combs integral within a single body. "Single comb" emphasizes the overall image of the comb as resembling and being recognized as a common, single comb. The two internal combs are referred to as "two combs." and each internal comb is referred to in the singular as simply a "comb."

(2) Description of Related Art Including Information Disclosed Under 37 CFR 1.97 and 1.98

So-called "fountain combs" have been patented for a long time, a group which is well represented by the references of record.

The closest reference, to the inventors' knowledge, is the patent to Charley S. Wilson, U.S. Pat. No. 2,446,398, issued Aug. 3, 1948. Wilson discloses a fountain comb with two pistons for forcing two different liquid hair products through holes between comb teeth into the hair. Wilson differs in a principal respect from the disclosed and claimed invention, inasmuch as both pistons feed into a single comb. Two disparate hair products which should not be mixed cannot avoid coming in contact with each other within Wilson's single comb. A second, major, difference is that the pistons act only partially per stroke, delivering no more than the volume of valve chamber 26 during each stroke. A pair of springs restore the pistons to their starting position after traveling only a minute part of the way of their entire length. The two plungers are no longer effective to force fluid into the single comb once the volume of fluid inside cylinder 35 has been injected, after perhaps three to five depressions of piston head 41. The claimed dual, comb shares neither of these results. One, the two combs are always separate. And, two, almost all of the fluid in a barrel can be ejected therefrom in a sustained motion.

U.S. Pat. No. 7,409,957, issued Aug. 12, 2008, to Aline Abergel is of passing interest. It is not completely clear how the embodiments shown in FIGS. 6-8 may be transformed from diagrammatic to a fountain comb, but it is irrelevant, inasmuch as when the comb is connected to a plurality of containers of disparate hair products, the passages in the comb body function to mix the products prior to dispensing the products from a single set of comb teeth from a single comb. Applicants disclose and claim two combs in a single comb structure where the two combs are completely separate.

The remaining references merely show the state of the art.

No prior art reference known to the inventors, singly nor in combination with any other prior art reference, provides a single fountain comb which house's two complete, separate, and independent fountain combs. The fusion comb, or dual comb, does.

BRIEF SUMMARY OF THE INVENTION

The fusion comb of the present invention comprises a single comb which simulates the approximate appearance of a traditional comb. The single comb houses two complete, separate, and independent combs. The two combs are separate physically by being in contact only through solid walls and are independent from each other in function in that they have no operational contact with each other within the fusion comb. Two such combs prevents the mixing of different liquids and/or solutions, if desired.

Each of the two combs comprises a multi-chamber comb that simplifies how to administer shampoos, dyes, conditioners, oil treatments, and/or liquid medicines to the scalp and hair. It uses a piston-type technology to force fluid out through the teeth of its comb. Used in reverse, it can suction fluid into the teeth, when the user does not wish to touch the liquid due to its temperature or caustic composition.

Two plungers are linearly aligned when in the single comb's housing, and each is open to just one multi-chamber comb. The plunger forces a hair product from a closed cylinder through the intermediate chambers, ending in a set of teeth where the fluid exits through one or more outlets into the hair.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings.

DETAILED DESCRIPTION OF THE INVENTION

Figure 1:
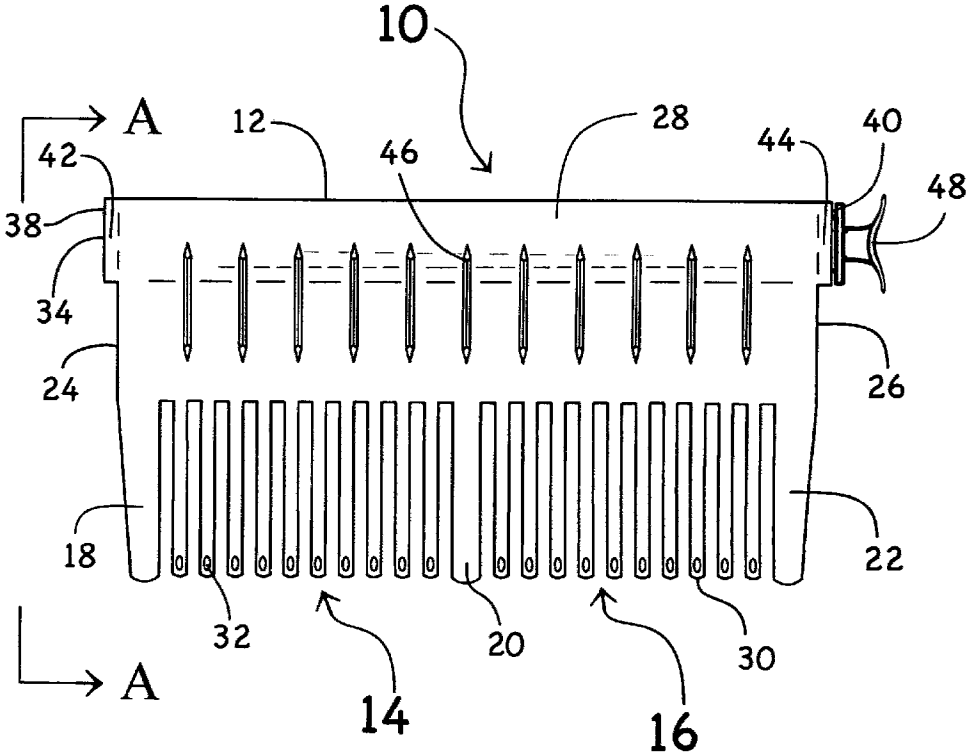
FIG. 1 is a front view of a preferred embodiment of the fusion comb.

A front view of a preferred embodiment of fusion comb 10 is shown in FIG. 1. Fusion comb 10 is an integral structure comprising a body 12. Body 12 is divided into two combs 14 and 16, each of which constitutes essentially one-half of body 12. Combs 14 and 16 are aligned end-to-end in a single plane to simulate a single comb 10. Fusion comb 10 is, therefore, a two combs within a single comb body.

Combs 14 and 16 are two separate and independent combs. A left thickened tooth 18 and an interior tooth 20 outline left comb 14, and they separate it from right comb 16. By the same token, interior tooth 20 and right tooth 22 outline right comb 16, and they separate it from left comb 14. Outside teeth 18 and 22 provide smoothness and strengthening of the edges 24 and 26 of fusion comb 10 and thereby strengthening of combs 14 and 16. Middle tooth 22 separates and strengthens combs 14 and 16. Tooth 20 helps the user to clearly know visually and tactually which comb is being used.

(Relative locations in and on comb 10, such as "left" and "right" and "top" and "bottom" are as seen when looking at the drawings. And, in the specification and claims, "comb" will be used alone when referring to either comb 14 and/or comb 16, and "fusion comb" will refer exclusively to the entire body 12. It must be noted that teeth 18-22 individually or collectively are not strictly necessary in order to practice the invention, so any or all of them may be eliminated.)

Body 12 is comprised of a handle 28 and teeth 30. Each of combs 14 and 16 show ten teeth 30 uniformly spaced apart at specific linear distances and with selected angular spacings, but the number of teeth and their relative orientation may vary. Each tooth 30 has a pair of oval outlets 32 located near its free end. Oval outlets 32 pass completely through teeth 30 and open to the front and the back of each tooth 30. Outlets 32 are shown as oval-shaped, but they may be of any functioning shape, e.g, circular, and still be within the purview of the invention.

Figure 2:
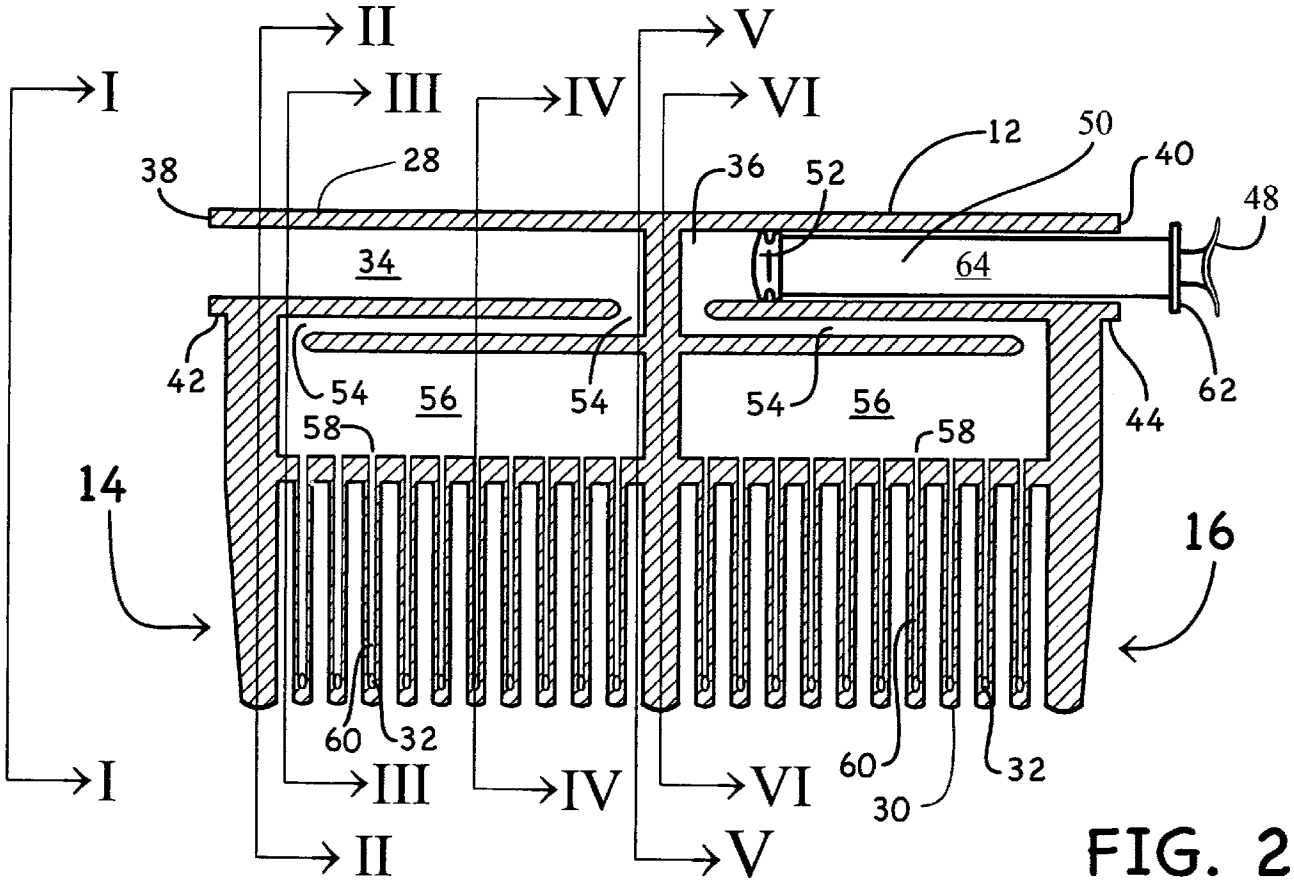
FIG. 2 is a cross-sectional view of the first embodiment of the fusion comb of FIG. 1 as seen along lines X-X in FIG. 1(A)

Turning momentarily to FIG. 2, a pair of receptacles, comprising barrels 34 and 36 are integrally formed as a part of fusion comb 10 and are arranged linearly in handle 28 between left end 38 and right end 40. Barrels 34 and 36 comprise smooth, cylindrical cavities, and each are open to the atmosphere at their ends 38 and 40, respectively. Rings 42 and 44 surround the external entrances to barrels 34 and 36, respectively, for at least two purposes. One, the volume of barrels 34 and 36 are controlled by adjusting the length of each ring 42 and 44, controlling the volumes by extending the rings selected distances from body 12. The controlled volume of barrels 34 and 36 ensure that control over the amount of hair product is effected also. The lengths as shown are illustrative only. Two, it is well known that a pipe is stronger than a bar. A ring is applied to each barrel to strengthen its opening to prevent the openings into fusion comb 10 from cracking.

Referring back to FIG. 1, ridges 46 are spread along both sides of body 12 so that a firmer hand-grip is provided. It is preferred that ridges 46 be molded into body 12 either as long, narrow grooves or as long, narrow prominences, as shown in FIG. 1. But, ridges 46 may also be added as a separate piece.

Figure 1A:
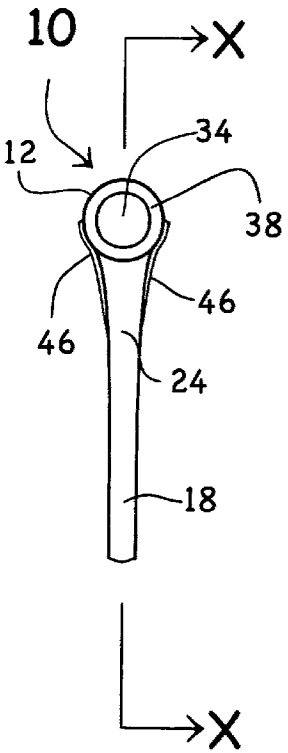
FIG. 1(A) is an end view of the first embodiment of the fusion comb of FIG. 1 as seen along lines A-A in FIG. 1.

FIG. 1(A) is an end view of fusion comb 10 as seen looking into barrel 34 along lines A-A in FIG. 1. The increased width of handle 28 relative to teeth 18-22 and 30 is more noticeable in FIG. 1(A). Tooth 18 smoothly joins with side 24 and ring 42. Ridges 46 are located on both sides of body 12 in FIG. 1, although both number and/or placement may vary.

Returning to FIG. 2, a cross-section of fusion comb 10 along the lines x-x in FIG. 1(A) is shown. The fingerpiece 48 of a plunger 50 extends outwardly along the axis of barrels 34 and 36. The inventory of parts of fusion comb 10 comprises only three pieces, body 12 and a pair of plungers 50 (only one shown in FIG. 2). Plungers 50 are discussed in more detail in FIGS. 6-8. Only one plunger is shown in FIGS. 1 and 2, in order to show barrel 34 opening externally into the atmosphere. Plungers 50 are snuggly fitted into barrels 34 and 36, when they are inserted within them. The smooth sides of barrels 34 and 36 help to prevent plungers 50 from leaking, and they allow easy insertion and use therein. And, the smooth sides contribute positively to the cleaning of barrels 34 and 36. During storage and/or travel, plungers 50 can be left in fusion comb 10.

Comb 14 is the mirror image of comb 16, so both have identical but oppositely facing elements. For simplicity, the reference numerals assigned to elements in the system of barrel 34 will be applied to identical elements in the system of barrel 36. As a result, the discussion of each comb 14 and/or 16 can bounce back and forth with clarity, so long as both are watched together, even though only one end is being discussed at the time.

Looking at comb 16, barrel 36 comprises a cylindrical tube extending through end 40 and ring 44 of handle 28. Barrel 36 is of a constant, smooth diameter, identical in diameter as barrel 34, and is of the same diameter as the squeezed, flexible end 52 of plunger 50, and thereby, just a smidgeon larger than the diameter of plunger 50. Flexible end 52 is in the form of a cap and seals the interior of barrel 36 and the remainder of the interior of fusion comb 10 from the ambient. Flexible end 52 can be made of any known rubber or soft plastic, just as long as it is an effective seal of its related barrel and restores itself to its non-collapsed state when plunger 50 is removed from its barrel. Plunger 50 is of such a diameter relative to barrels 34 and 36 that it allows for easy insertion and withdrawal while seating snuggly within the barrels. The length of barrel 36 is from end 40 to the solid extension of middle tooth 18, essentially the length of comb 16. A small passageway 54 intersects the inner end of barrel 36 and weaves its way circuitously from cylindrical barrel 36 into reservoir 56. Reservoir 56 includes a plurality of entrances 58 open to an equal number of long, thin, open channels 60, one within each tooth 30. Each channel 60 connects its entrance 58 with its oval outlets 32.

Comb 14 is the mirror image of comb 16. Circuitous passageway 54 opens to the inner end of barrel 34 at one end and reservoir 56 at the other. Entrances 58 and channels 60 complete the open path from reservoir 56 to outlets 32. Another plunger 50 (not shown) is normally in barrel 34.

As is apparent, all of the chambers which are in open communication with each other are in one and only one separate and independent comb 14 or 16. Combs 14 and 16 are separate physically in that although body 12 of comb 10 is an integral structure which houses both combs 14 and 16, body 12 can be cut in half by a vertical line essentially along line VI-VI of FIG. 3, and each of the two combs 14 and 16, in combination with one of plungers 50, will still be whole and functional. Combs 14 and 16 are independent in function, inasmuch as either one is fully operable without the other being used at all. That is, they have no operational contact with each other internally of the fusion comb.

In use, a liquid hair product, such as hair oil, hair tonic, or hair dye, or a medication for the scalp is poured into either barrel 34 or 36 for application to the hair and/or scalp. A plunger 50 is inserted through ring 42 or 44, and the flexible end 52 of plunger 50 (or the O-rings 84, 86 on the plungers of FIGS. 7 and 8, described below) seals the system, constraining the flow of the fluid therein. The fluid will not flow through barrel 34 or 36, passageway 54, reservoir 56, channel 60, and outlet 32 by itself, due to the vacuum inherently created in a sealed system. The atmospheric pressure acting on the fluid through outlets 32 prevents any flow of fluid from the systems in fusion comb 10. The restricted dimensions of passageways 54 and channels 60 also act to constrain fluid flow therethrough. The size and shape of passageway 54 and channel 60, whether circular or oval shaped, and the respective lengths thereof may vary considerably so long as the hair product does not flow freely through fusion comb 10. The fluid's capillary action is insufficient to pull the fluid through passageway 54 and channels 60, also.

When a human being uses barrel 36, for example, the index finger applies pressure to fingerpiece 48 of plunger 50 while the remainder of the hand firmly grips handle 28. The human pressure moves plunger 50 inwardly axially of barrel 36 and forces the fluid out of cylindrical barrel 36, through passageway 54, and into reservoir 56, where it spreads evenly over entrances 58. Further pressure forces the product through channels 60 and out through outlets 32. When plunger 50 is depressed until flange 62 contacts end 40, the body of plunger 50 almost completely fills barrel 36 (see FIG. 2), guaranteeing that almost all of the hair product is forced from barrel 36, minimizing wastage.

Added assurance that fluid will riot escape through the teeth during pouring the fluid into a barrel is provided by the internal structure of fusion comb 10. To better understand pouring of the hair product into fusion comb 10, refer again to FIG. 2. When readying fusion comb 10 to receive a liquid hair product, fusion comb 10 is first rotated ninety-degrees, e.g., clockwise, about an line extending outwardly from a point central of handle 28 (FIG. 1), which would cause the end opening into barrel 34 to be uppermost. The fluid will be confined to barrel 34 for two reasons: One, the fluid will not flow through passageway 54 due to its cross-sectional size, and two, if fluid did flow through passageway 54, it would not exit until it reached the entrance to reservoir 56 at the highest closed perimeter of passageway 54, at which time barrel 34 would be full, since fluid seeks its own level.

Placing outlets 32 adjacent the tips 30 places the hair product at the roots of the hair, when fusion comb 10 is used. Opening outlets 32 on opposite sides of teeth 30 allows the user to use either the right or the left hand to hold fusion comb 10. Outlets 32 being open to the front and the back also allows the user to be able to hold the comb at any given angle and be able to distribute the fluid evenly at the root of the hair and then to the hair's body.

In addition, excess fluid, as from a hot oil treatment, may be removed by suction from the scalp by fusion comb 10. This is especially useful when the user does not want to expose his or her hand to the temperature or composition of the liquid. Preferably, an empty fusion comb 10 with the plungers 50 fully inserted is warmed and then is inserted into the hair. By slowly withdrawing each plunger, a fine control of suctioning the excess fluid from the head is effected.

The suction process also allows fine control, when filling barrels 34 and/or 36 with a hair product. By placing the teeth openings into the fluid to be lifted, with plungers 50 fully within their respective barrels, the slow removal of the plungers from handle 12 creates a vacuum within fusion comb 10 which forces the fluid in through the outlets. Suctioning has an added feature: It fills all the interior chambers first before the fluid reaches and fills the barrels. More hair product is inserted, therefore.

Because of ridges 46, the remaining fingers can firmly grip fusion comb 10 while the first finger of the user's hand easily manipulates a fingerpiece 48. Ridges 46 also aid the infirmed or otherwise handicapped to efficiently use fusion comb 10. When fusion comb 10 is being used in a shower or with slippery hair products, it oft-times becomes slippery itself. Ridges 46 are a great help in holding fusion comb 10 safely and securely.

Fusion comb 10 is cleaned simply by flushing it out using the plungers to both impel and expel the cleaning fluid.

Note again that comb 14 and comb 16 operate completely independently of each other. This is intentional and allows two separate hair products to be used during the same time period without having to switch from one comb to another. For instance, comb 14 may contain one hair product, e.g., a shampoo, while comb 16 houses another, e.g., a conditioner. Fusion comb 10 is also great when it is necessary to use two products sequentially, and a limited time period is afforded. The user can switch from one to the other simply by turning the fusion comb 10 around. In addition, two disparate solutions will not be mixed together prematurely. Alternatively, two combs in one single body doubles the amount of one product which may be used without refilling the barrel, when one deems that one comb will not hold enough for one application. Finally, having two separate combs lends itself to using the fusion comb to massage, wash, and groom an animal's hair.

Fusion comb 10 may profitably be made of a transparent or translucent material, so that viewing the product is always available. In addition, a transparent comb has a certain visual and commercial appeal.

It is contemplated that manufacture of fusion comb 10 comprises two molded halves, substantially the back half shown in FIG. 2 and a front half whose walls are internally complementary with those of the back half, which are joined together by any known, convenient solidifying method. Fusion comb 10 is, therefore, economical to make as well as it is easy to use.

Figure 3:
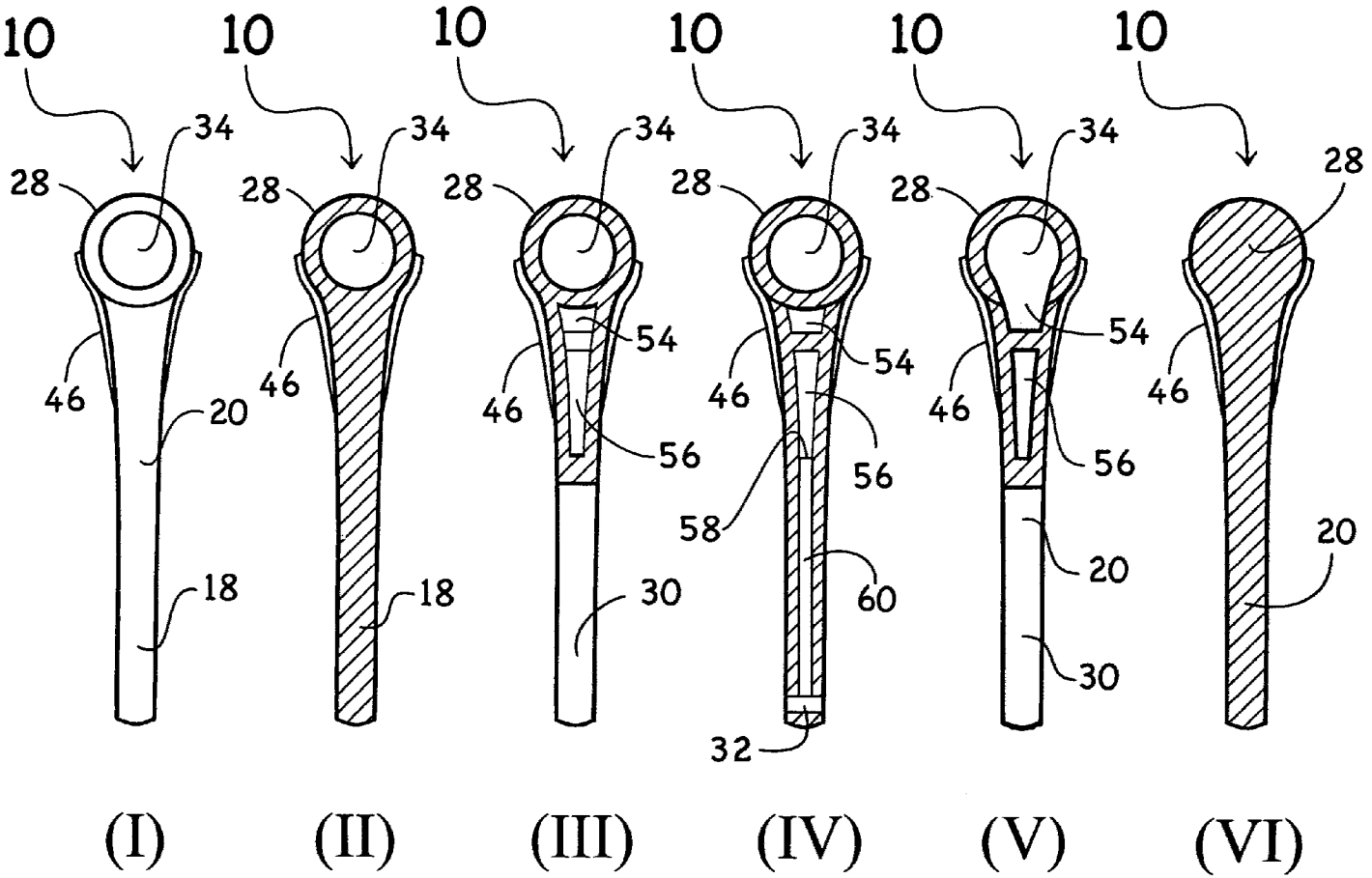
FIGS. 3(I)-(VI) is a set of six cross-sectional views of the fusion comb of FIGS. 1 and 2 as seen along lines I-I through VI-VI of FIG. 2.

Cross-sectional lines I-I through VI-VI are added to FIG. 2 at locations to select representative ones of the internal walls and cavities of comb 14 for viewing. The cross-sectional views can be seen in FIG. 3. FIGS. 3(I)-(VI) show the side views of comb 10 at six different cross-sectional areas. They run the gamut from solid tooth 18 (FIGS. 3(I)-(II)) to solid tooth 20 (FIG. 3(VI)). Barrel 34 joins passageway 54 in FIG. 3(VI) which bends into reservoir 56 in FIG. 3(III). And, all three, barrel 34, passageway 54, and reservoir 56, are visible in FIG. 3(IV).

That the view is a side view in FIGS. 3(I)-(V I) continues the detailed discussion of the preferred embodiment of FIG. 1. Overall, the cross-sections show combs 14 and 16 are broadest in the handle 28, due to the diametrical width of barrel 34. Handle 28 slopes inwardly from barrel 34 to substantially linearly extending teeth 30.

Ridges 46 follow the arcuate contour of the handle 28 slope. To avoid clutter, only the ridges 46 which appear on the back of fusion comb 10 have been given reference numerals, i.e., the left side of the cross-sections in FIGS. 3(I)-(VI), even though they are an integral part of fusion comb 10 on its front and back.

The front and back inside side-walls of passageway 54 and reservoir 56 slope inwardly, tapering from top to bottom toward the comb center; see FIGS. 3(111)-(V). This inward slope allows the fluids flowing through passageway 54 and reservoir 56 to flow faster and more smoothly across the upper areas, so that the hair product is spread more evenly across their lower areas and ultimately across all of the entrances 58. A path with straight, vertical sides is not as efficient, but it is within the purview of the claimed invention; see FIG. 6(A). Also seen in FIG. 3 (IV) are the entrance 58 to channel 60 and outlets 32 opening to the front and back of tooth 30.

Figure 4:
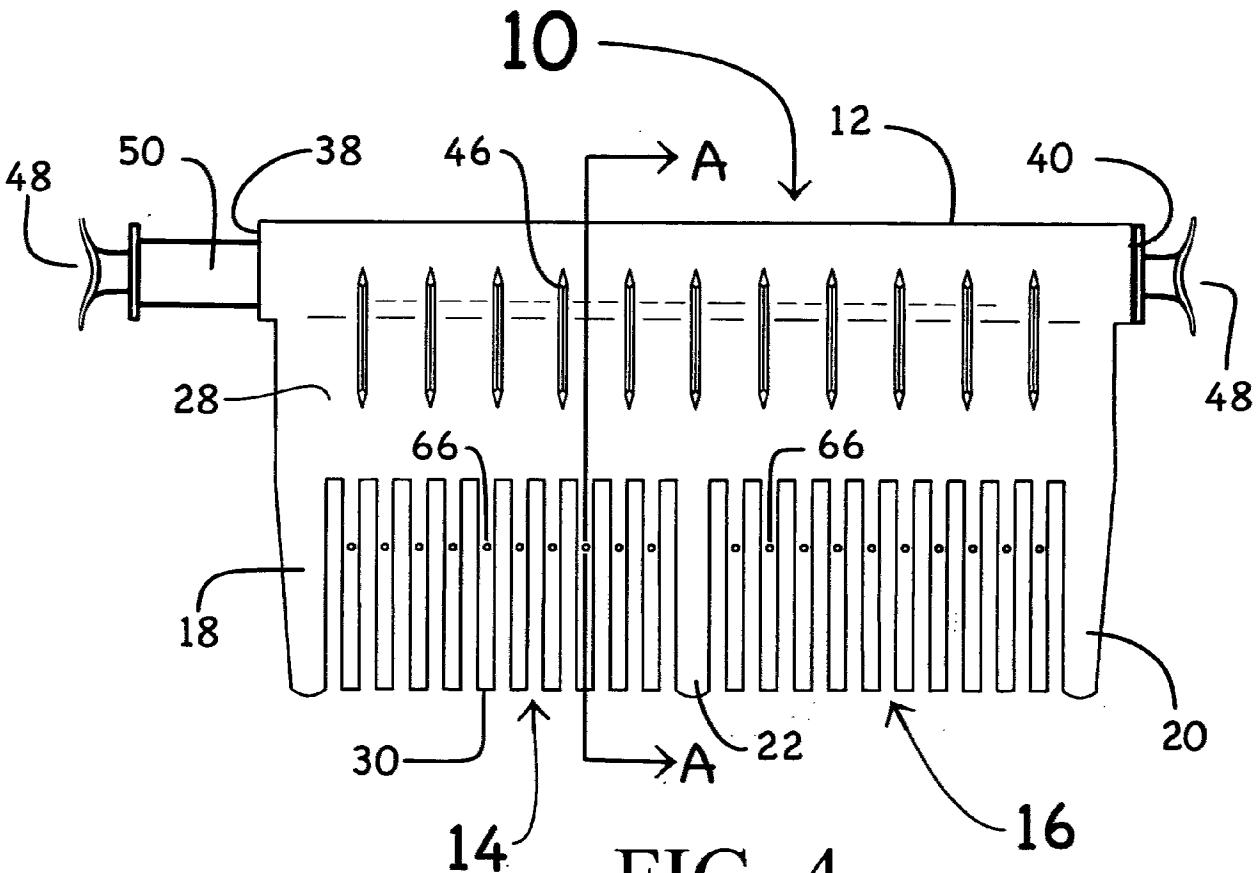
FIG. 4 is a front view of a second preferred embodiment of the inventive fusion comb.
Figure 4A:
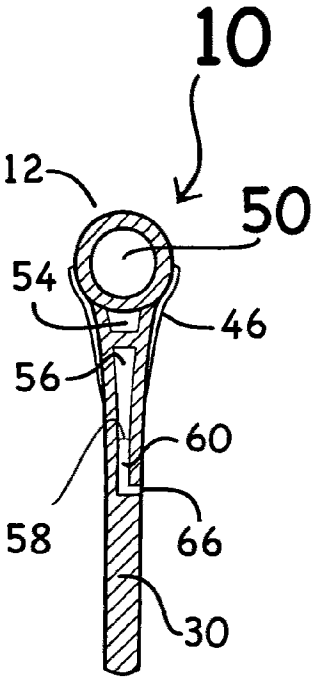
FIG. 4(A) is a cross-sectional view of one of the teeth of the fusion comb as seen along lines A-A of FIG. 4.

A second preferred embodiment is shown in FIGS. 4 and 4(A). The broad features of fusion comb 10, the usual handle 12, ridges 46, and thickened teeth 18, 20, and 22, is referenced to orient the reader. Other standard features include plungers 50 which protrude from each end 38 and 40, respectively, of handle 12. Only the fingerpiece 48 of the right plunger 50 is visible, the remainder of plunger 50 being hidden inside body 12.

The cross-section of comb 14 is shown in FIG. 4(A). FIG. 4(A) is essentially the same cross-section as cross-section (IV) in FIGS. 2 and 3. This embodiment of the invention differs from its predecessors in adopting a variation in placement of the fluid outlets. In FIGS. 1-3 outlets 32 connect the ambient to internal channel 60 near the bottom of teeth 30. In FIGS. 4 and 4(A) outlets 32 have been closed and outlets 66 allow egress of the fluid hair product. Outlets 66 are circular and only open to the ambient on the front side of fusion comb 10 near the top of teeth 30; see FIG. 4. The rear end of each outlet 66 opens only to internal channel 60, and channel 60 extends down only to outlet 66. Placement of outlets 66 adjacent the upper end of teeth 30 applies the hair product to the outer portions of the hair, i.e., at a finite distance removed from the roots and scalp, in order to distribute the liquid more evenly throughout the hair. Fluids are distributed from outlets 66 to intermediate areas in the body of the hair where it runs both ways to the tips and the roots. This is critical for some techniques and types of hair. By having outlets 66 on only one side enhances control of application of the hair product. The size and location of outlets 66 are variable and may be changed.

Figures 5, 5A:
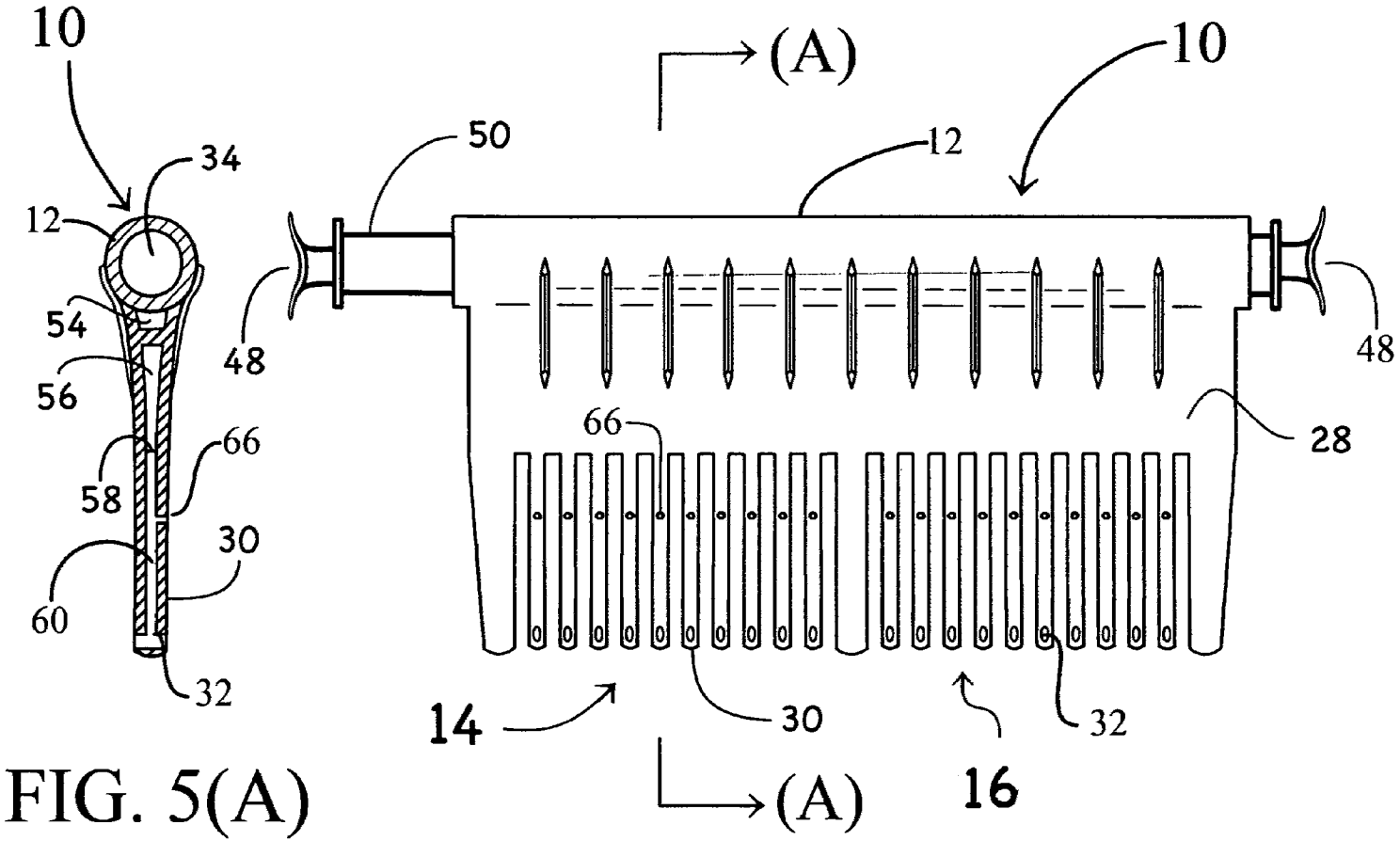
FIG. 5 is a front view of a third preferred embodiment of the inventive fusion comb, the combination of the embodiments of FIGS. 1 and 4.
FIG. 5(A) is a cross-sectional view of one of the teeth of the fusion comb of FIG. 5 as seen along lines A-A of FIG. 5.

FIG. 5 shows a third preferred embodiment of fusion comb 10. In FIG. 5, fusion comb 10, its body 12, and its two separate combs 14 and 16 are identified along with two plungers 50. FIG. 5 differs from FIGS. 1 and 4 in that both outlets 32 and 66 are included in each tooth 30, both of which are open to internal channel 60. Channel 60 extends almost the full length of its tooth 30 from entrance 58 to outlet or outlets 32.

FIG. 5(A) shows the cross-section of fusion comb 10 along the lines A-A of FIG. 5. Specifically, the interior of tooth 30, barrel 34, passageway 54, and reservoir 56 of comb 14 emphasizes the similarities of all the disclosed combs. Again, the difference with prior embodiments is that both outlets 32 and 66 are included in each tooth 30. Compare with FIGS. 3 (IV) and 4(A).

Figure 6:
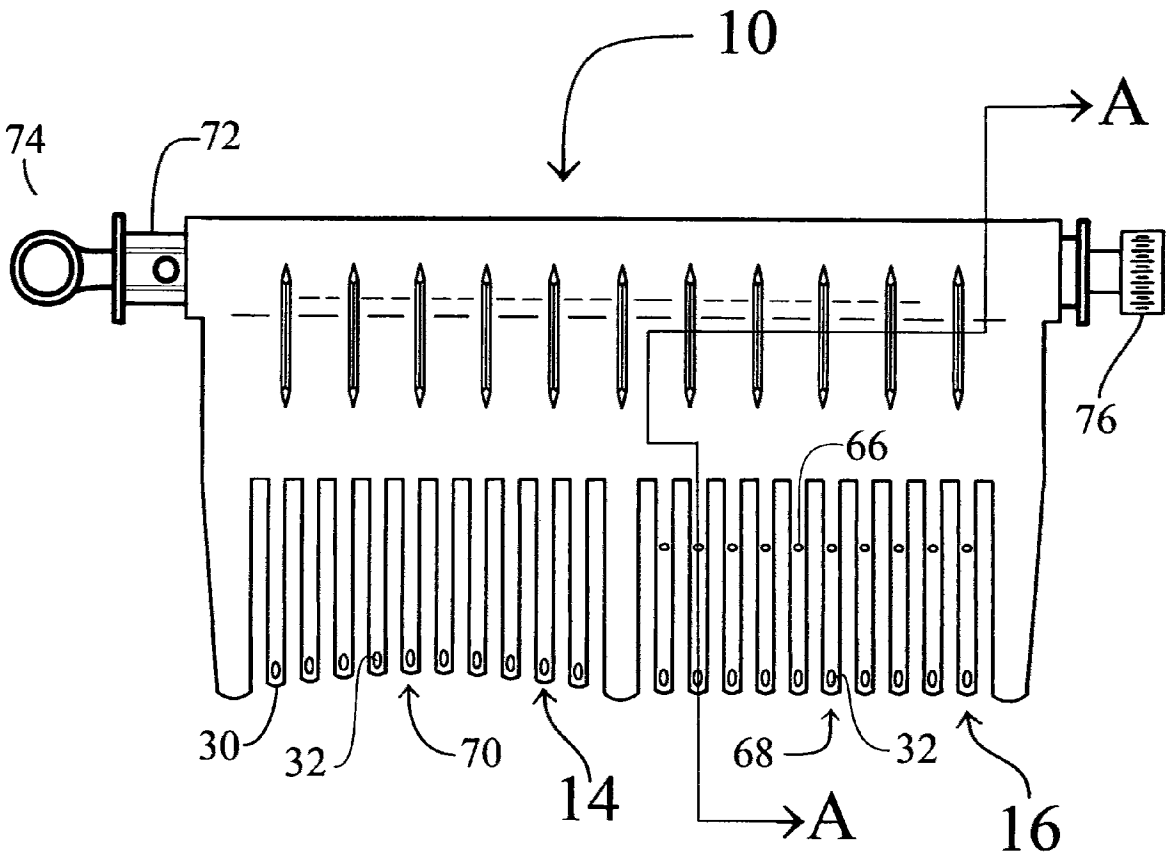
FIG. 6 is a side view of a conglomerate of features of other embodiments of the fusion comb.
Figure 6A:
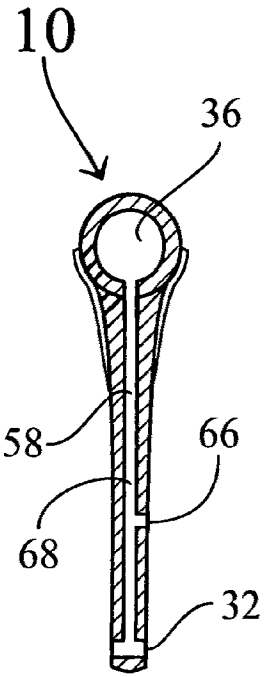
FIG. 6(A) is a cross-sectional view of one of the teeth of the fusion comb of FIG. 6 as seen along the tortuous path of lines A-A of FIG. 6.

A hodgepodge of possible permutations is shown in FIGS. 6 and 6(A). It is not suggested that these permutations be used in any particular combination, but of course any may be combined with any permutation. In FIG. 6, the usual fusion comb 10 comprising two separate combs 14 and 16 is shown. The teeth 30 of comb 14 have a concave envelope 70, curved to simulate the curvature of the human head. The internal cavity 68 of each separate comb comprising barrel 36, passageway 54, reservoir 56, and channel 60 is continuous as seen along the tortuous and convoluted lines A-A of FIG. 6. Other than barrels 34 and 36, each other part of the internal cavity 68, including the portion comprising reservoir 56 and channels 54 and 60 is of uniform thickness, namely, the diameter of passageway 54, as seen in FIG. 6(A).

Fingerpiece 48 (FIGS. 1-2 and 4-5) is the preferred embodiment of the fingerpiece of plungers 50. They are relatively flat (slightly concave) and therefore are close to body 12, when plungers 50 are fully inserted into barrels 34 and 36. This cuts down the exposed profile for fingerpieces 48, which increases their safety factor during storage or travel. However, they are ergonomically friendly. They can be easily pushed with the end of a finger or thumb or pulled by grasping its edge. The preferred plunger fingerpiece can be replaced by any fingerpiece which exhibits these features. For example, a commercially available plunger 72 has a ring-type fingerpiece 74 integral therewith; a finger may push ring 74 or be inserted therethrough in order to pull. And, a common knurled knob 76 can also be used in the invention. As apparent from the appended claims, the choice of type of plunger and fingerpiece is open to the designer.

Figure 7:
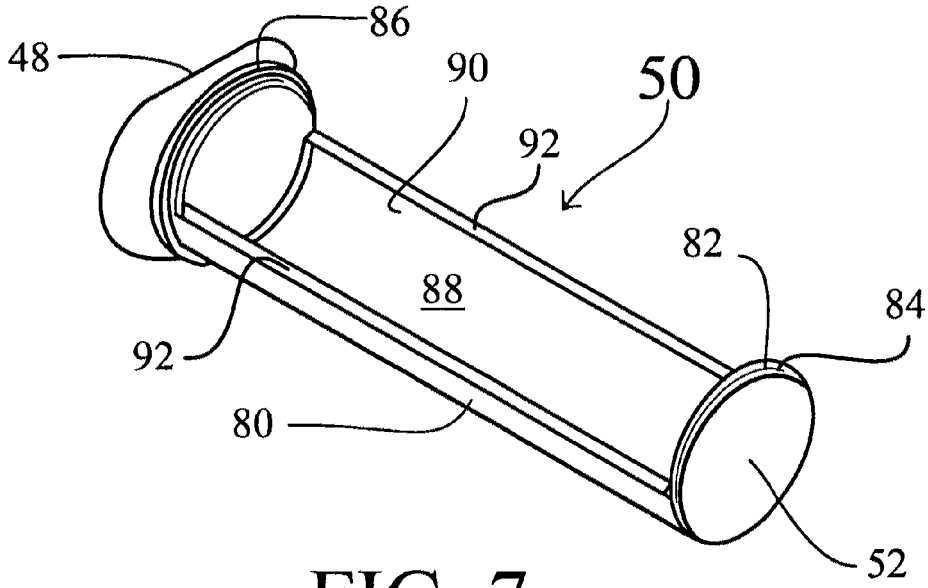
FIG. 7 shows a perspective view of a preferred embodiment of the plunger.
Figure 8:
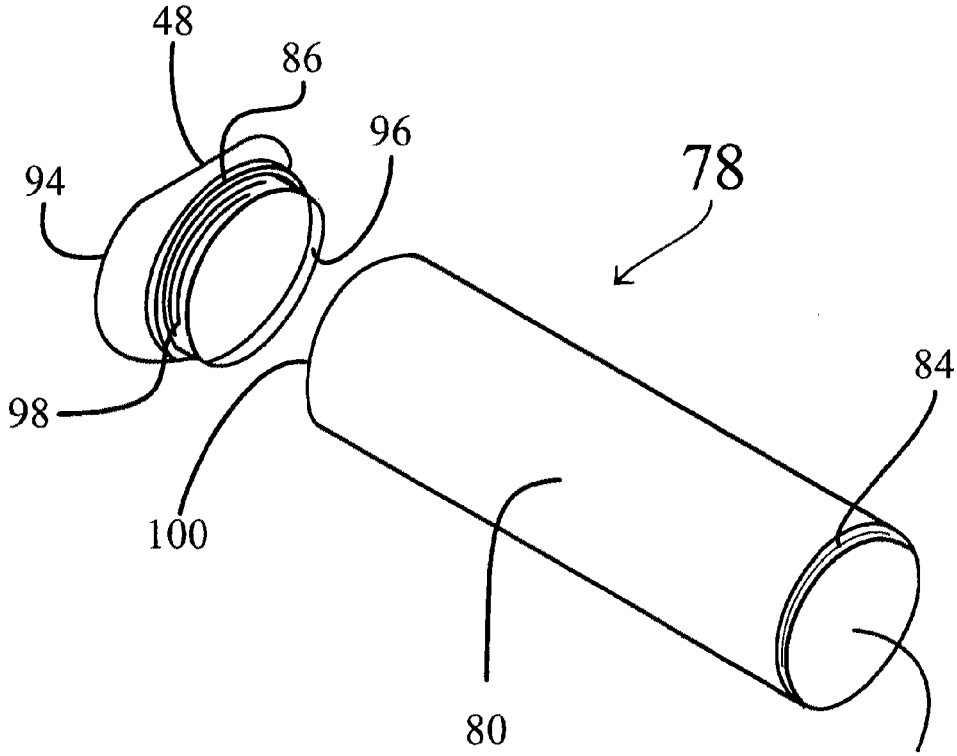
FIG. 8 shows a perspective view of an alternative embodiment of the plunger.
Figure 9:
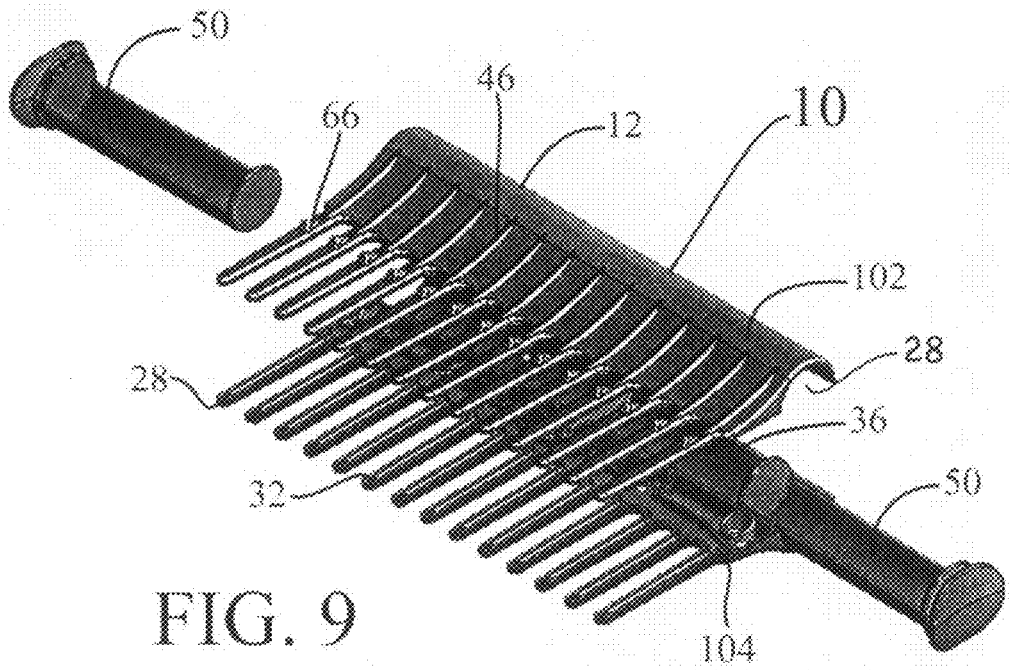
Figure 10:
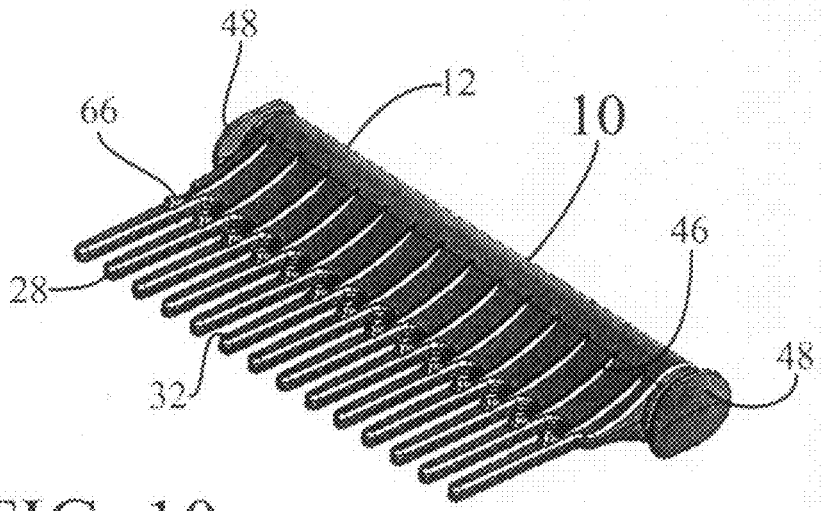
Figure 13:
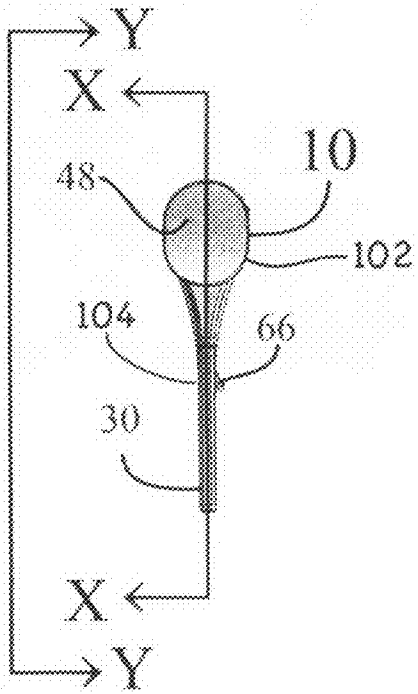
Figure 11:
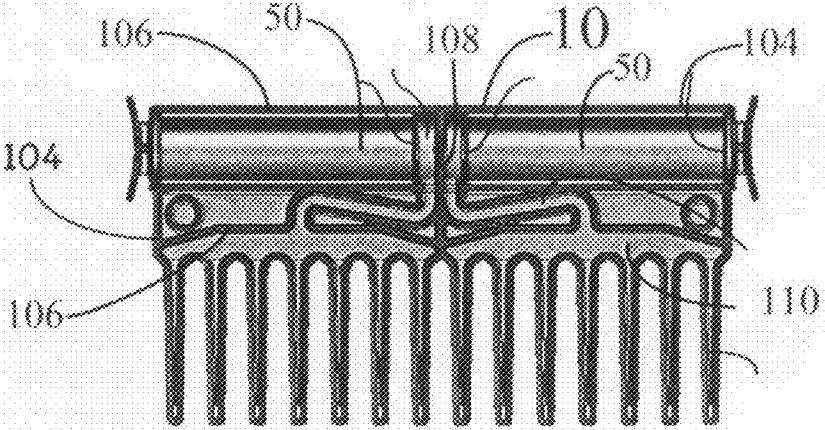
Figure 12:
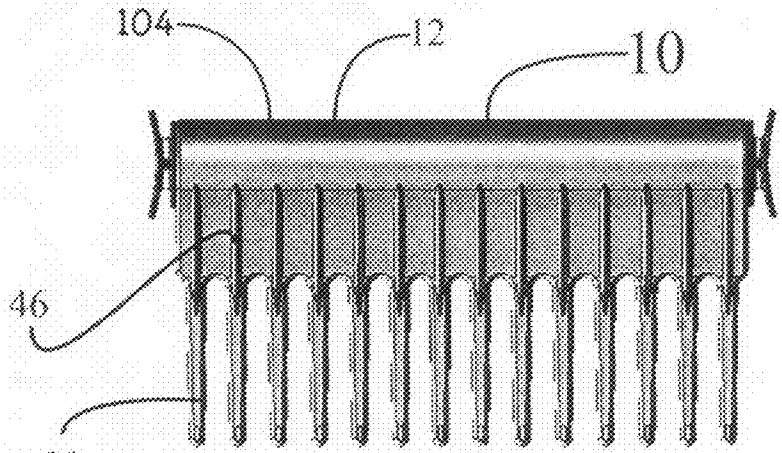

The preferred plunger 50 and an alternative plunger 78 are shown in FIG. 7 and FIG. 8, respectively. Plunger 50 includes an elongated, semi-cylindrical body 80. Preferred fingerpiece 48 is at the outer end of body 80 and extends therefrom. A flexible end 52 is at the inner end and is normally positioned within fusion comb 10. The flexible end 52 of plunger 50 is preferably in the form of a rubber cap with a relatively soft, squeezable flange 82 which seals its barrel. Alternatively, end 52 has a smooth flange depending from a flat, cap-like construction. In this configuration, end 52 has an O-ring seal 84 which surrounds body 80 at the inner end thereof. A second O-ring seal 86 surrounds body 80 at the front end thereof. Plunger 50 is just a smidgeon narrower than the diameter of barrel 36, and seals 82 or 84, and 86 are slightly squeezed by barrels 34 and 36 in order to seal plunger 50.

Body 80 has a cavity 88 defined by a semi-cylindrical cup 90. Semi-cylindrical cup 90 of plunger 50 is designed to store a liquid hair product for storage or when traveling. Hair product is poured into cavity 88, whenever preparing the product for storage or for travel, and plunger 50 is inserted completely into either barrel 34 or 36. The open edges 92 and semi-cylindrical cup 90 fit the barrels close enough that they and seals 84 and 86 prevent the loss of fluid from cup 90 either out the open end of the barrel or through teeth 30. Of course, inasmuch as plunger 50 needs to be inserted completely within its barrel for travel, the barrel itself cannot be used for storing fluids at that time. When it is desired to use the hair product, plunger 50 is removed from its barrel, and the hair product is poured into the barrel.

Referring to FIG. 8, an alternative plunger 78 is presented. End 52 is integral with body 80 which forms a closed, cylindrical structure. Fingerpiece 48 comprises a screw cap 94 and includes a nub 96 extending away from fingerpiece 48. Nub 96 has external threads 98 which engage internal threads (not shown) surrounding an interior opening 100 at the fingerpiece end of body 80. O-ring seal 86 acts as a washer and seals between the end of body 80 and fingerpiece 48, when cap 94 is screwed into body 80, preventing the loss of fluid from closed body 80. Storage, travel, and use is as above.

All dimensions are approximate and can be changed at will without warning. They are included only to give the reader a general idea of the approximate size of the elements which make up the fusion comb.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is it intended to be limiting as to the scope of the invention in any way.

It is to be understood that the disclosure is by way of illustration only and that the scope of the invention is to be limited solely by the following claims:

We claim:

1. A dual comb, comprising:

a single comb body comprising a spine on its top edge;

said single comb body comprising first and second combs, said first and second combs being integrally formed within said body and separated by at least one internal wall;

each of said first and second combs comprising:

a receptacle for receiving a fluid, said receptacle being a cylinder having smooth walls and an open end;

a reservoir;

a convoluted passageway connecting said receptacle and said reservoir;

a plurality of teeth, each tooth comprising a channel therethrough connecting said reservoir with at least one outlet open to the ambient through said tooth; and a plunger replaceably inserted into said receptacle for physically forcing said fluid through said receptacle, said passageway, said reservoir, and said teeth; and said open end of said cylindrical receptacle of said first comb and said open end of said cylindrical receptacle of said second comb facing outwardly from opposite end edges of said single comb body, said single comb body enclosing both of said cylindrical receptacles along said top edge to form a handle; and said plurality of teeth of both said first comb and said second comb extending in the same direction from said spine and being aligned in a single row.

2. The dual comb of claim 1 wherein said first and second combs are mirror images of each other, said first and second combs being separated by at least one internal wall formed within said body.

3. The dual comb of claim 1 wherein said receptacles are axially aligned end-to-end near said top edge, said open ends of said receptacles face outwardly from opposite end edges of said body.

4. The dual comb as in claim 3 wherein said channels in said teeth are substantially linear and the walls of both of said passageway and of said receptacle taper toward one other from their top to bottom until joining with the walls of said substantially linear channels in said teeth.

5. The dual comb of claim 3 further comprising a set of ridges on said dual comb body in order to aid in gripping said dual comb.

6. The dual comb of claim 3 wherein said plungers extend outwardly from said open ends of said receptacles and wherein these lie at opposite ends of said spine.

7. The dual comb of claim 6 wherein each of said plungers comprises an elongated, semi-cylindrical cup with a solid bottom and an open top, a circular end closing one end of said cup, and a combination second circular end and fingerpiece closing the other end of said cup, said combination second circular end and fingerpiece extending from said open end of each of said receptacles.

8. The dual comb of claim 3 wherein said channel connects said reservoir with at least one outlet in each tooth, said at least one outlet opening in a front side of said tooth.

9. The dual comb of claim 8 wherein said at least one outlet comprises a first outlet opening adjacent an upper end of said tooth.

10. The dual comb of claim 8 wherein said at least one outlet comprises a second outlet opening adjacent a tip of said tooth.

11. The dual comb of claim 10 wherein a third outlet opens to a back side of the tooth the same distance from the tip of said tooth as said first outlet.

12. The dual comb of claim 1 wherein a first outlet comprises a single outlet located on a front side of its tooth adjacent an upper end of said tooth, and second and third outlets comprise two outlets located adjacent a tip thereof, said two outlets located across the tooth from each other, one open to the front side of its tooth and the other open to a back side of its tooth.

13. The dual comb of claim 1 wherein said body is made of a transparent material.

14. The dual comb of claim 1 wherein said body is made of a translucent material.

15. A plunger for a fountain comb, comprising:

a cup, said cup being solid with an essentially semi-circular shape in cross-section from a first end of said cup to a second end of said cup, the top of said cup being open;

a fingerpiece, said fingerpiece including an inner circular portion joined with a first end of said cup and closing said first end of said cup, said fingerpiece comprising an ergonomically shaped plate which is slightly concave;

a circular end portion joined with said second end of said cup and closing said second end of said cup;

and a pair of seals encircling the ends of said cup, one around said inner circular portion and one around said circular end portion, said seals contacting the inner walls of said cylindrical barrel to seal the contents of said semi-circular, solid cup, wherein said plunger serves as a sealed storage unit for a reserve supply of hair product, when said plunger is housed within a fountain comb.

* * * * *